US005533951A

United States Patent [19]

Chang

[11] Patent Number: 5,533,951

[45] Date of Patent: Jul. 9, 1996

[54] EQUILIBRIUM BREAKING TYPE LOAD CARRYING MEANS FOR USE IN A TREADMILL

[76] Inventor: Chun-Hsiung Chang, No. 5-4. Lane 201, Chung-Hua Rd., Pa-Te Hsiang, T'ao-Yuan Hsien, Taiwan

[21] Appl. No.: 371,416

[22] Filed: Jan. 11, 1995

[51] Int. Cl.[6] ..... A63B 22/02

[52] U.S. Cl. ..... 482/54; 198/841

[58] Field of Search ..... 482/54, 51; 198/841

[56] References Cited

U.S. PATENT DOCUMENTS 3,837,470 9/1974 Dunkin ..... 198/841

*Primary Examiner*—Lynne A. Reichard
*Attorney, Agent, or Firm*—Varndell Legal Group

[57] ABSTRACT

An equilibrium breaking type load carrying means for use in a treadmill, mainly comprising a running belt, a running board, supporting rails, and motion generating devices capable of producing a regular motion. At least one set of the motion generating device is attached to supporting rails of a treadmill for causing a friction media underneath a foot surface of the running belt up move to and down with respect to the running belt. As a result, load carrying means of the invention can disturb the equilibrium of forces between the running board and the running belt, resulting in a decrease in frictional forces. Consequently, the performance of a treadmill is significantly enhanced and the difficulties in design and production are decreased.

11 Claims, 10 Drawing Sheets

EQUILIBRIUM BREAKING TYPE LOAD CARRYING MEANS FOR USE IN A TREADMILL

BACKGROUND OF THE INVENTION

1. Field of the Invention

The invention relates to an equilibrium breaking type load carrying means for use in a treadmill and, in particular, to an equilibrium breaking type load carrying means that uses motion generating devices to produce a regular up and down motion by which the equilibrium of forces between a running belt and board of a treadmill are broken, resulting in a reduction in friction forces between the running belt and board of the treadmill and an enhancement of a treadmill's performance.

2. Description of a Prior Art

Along with advances in social economies and scientific technologies, it has become popular for people to use treadmills for physical training or maintaining physical strength. However, the prior art treadmills have many drawbacks in design and production.

A prior art treadmill together with its load carrying means is shown in FIGS. 1 and 2. This treadmill has a running board 02 that sits on a receiving surface 03 of supporting rails 05 of a bear frame and is fastened by screws 01 to the supporting rails 05. By means of the relative motion between the running board 02 and belt 04, the treadmill functions to simulate running thereon by users for exercising purposes. However, such a design contains drawbacks as discussed below.

The present inventor tested treadmills available in the U.S. market. One such treadmill is a T-brand (TUNTURI) treadmill. This treadmill uses an AC 110 V power source and has a maximum load capacity of ninety kilograms and a maximum speed of ten miles per hour with an accuracy of plus or minus 0.5 miles per hour. Its motor output power is 1.75 hp, and it adopts T1 brand running boards and T2 brand running belts with a service life of 300 hours. The T1 brand running board combined with the T2 brand running belt is an excellent match, hardly substituted by other brand products. For instance, when in a low speed range (below 6 miles per hour), products of a first experimental group of conventional treadmills each consumed two to four more amperes in comparison with those of a second experimental group operated at varied speeds. The products of the second experimental group are T-brand treadmills and were tested under an eighty-five kilogram load and at a variety of speeds. In the second experimental group the consumed current load increased approximately linearly from six amperes to twelve amperes as the treadmill's speed increased from 0.6 to 10 miles per hour. In the gust experimental group, the consumed current load can reach a highest value of ten amperes for some products at a speed of six miles per hour. At that time, other functions of the treadmills work normally except for these unfavorable overcurrents. However, when treadmills of the second experimental group (TUNTURI brand) take an external load of eighty-five kilograms and run at ten miles per hour, the consumed current load is twelve amperes. If the running board (of T1 brand) or belt (of T2 brand) is replaced by other brand parts, the consumed current loads in all the experimental products under the same conditions was over twelve amperes. Some of these products cannot reach ten miles per hour, because the friction between running boards and belts is too large and the current load exceeds fifteen amperes, so that the automatic circuit breakers contained therein are actuated. On the average maximum household electricity capacity is fifteen amperes at 110 volts, thus the consumed current load of a treadmill must be below this value. For such reasons, the maximum speed of a conventional treadmill is restricted by the current capacity. This is a most significant drawback of a conventional treadmill.

Running boards used in a conventional treadmill cannot maintain a low friction condition for a long time. Perhaps about 30 hours is the maximum time. The low friction condition is important to reduce powder consumption due to friction between running boards and running belts or to provide a larger effective output power for the treadmill. In a prior art treadmill, the consumed electric current grows when the running board approaches the end of its service life, because the friction between the running board and belt increases at this time. This is another drawback of a conventional treadmill. As the ratio of power consumption for overcoming friction to motor output power decreases, the maximum speed and the load capacity of a treadmill increases.

In view of the above-mentioned drawbacks of a prior art treadmill, it would be advantageous provide a load carrying means having less friction.

SUMMARY OF THE INVENTION

The present invention provides an equilibrium breaking type load carrying means for a treadmill. Under conditions of using the same driving components for a treadmill, the effective power of a treadmill motor reflected in carrying loads is the remainder obtained by subtracting the friction loss between the running belt and the running board and other mechanical transmission losses from the output of the motor. In order to provide a regular motion that can break the equilibrium of forces between the running board and belt and in turn reducing friction losses, at least one motion generating device, which is attached at its end to the supporting rails of a treadmill, is arranged under the running belt in the structure of this invention. With this arrangement, the resulting treadmill consumes less power under the same load compared to a conventional treadmill without the at least one motion generating device. This results in the modified treadmill obtaining higher speeds and accepting higher external loads. This is a most important object of the invention.

An equilibrium breaking type load carrying means according to this invention can employ motion generating devices that reduce friction forces between the running board and belt, which results in an increase of the final effective output of a treadmill. This is another object of the invention.

The invention has been made to achieve the above and other objects. It includes at least one set of motion generating devices attached to supporting rails of a treadmill and capable of moving friction media underneath a foot surface of a running belt to produce a reciprocal relative motion between media and the running belt. The motion generating device breaks an equilibrium status or state of forces between the running board and the running belt and decreases friction forces as the running belt moves. Thus, a load carrying means according to this invention can significantly reduce the consumption of output power due to overcoming friction resistance, and thereby enhance the final effective power, speed limits, and the load capacity of a treadmill. In a practical application, the motion generating device can be made to directly drive or move a running board. In this ease, the running board becomes a friction medium for the running belt. In other applications, the motion generating device drives a third medium (or additional) layer disposed between a running board and a running belt as a friction agency of the belt. The motion generating device can be either an eccentric rotating device or a reciprocal linear displacement generating device powered by an electromagnet. Further, the invention can be adapted for use in an electrical type treadmill or a plain (non-electric) type treadmill.

The detailed structure, applied principles, and other features of the invention will become apparent from the following description of preferred embodiments when read in conjunction with the accompanying drawings.

DETAILED DESCRIPTION OF THE PREFERRED EMBODIMENT

Figure 1:
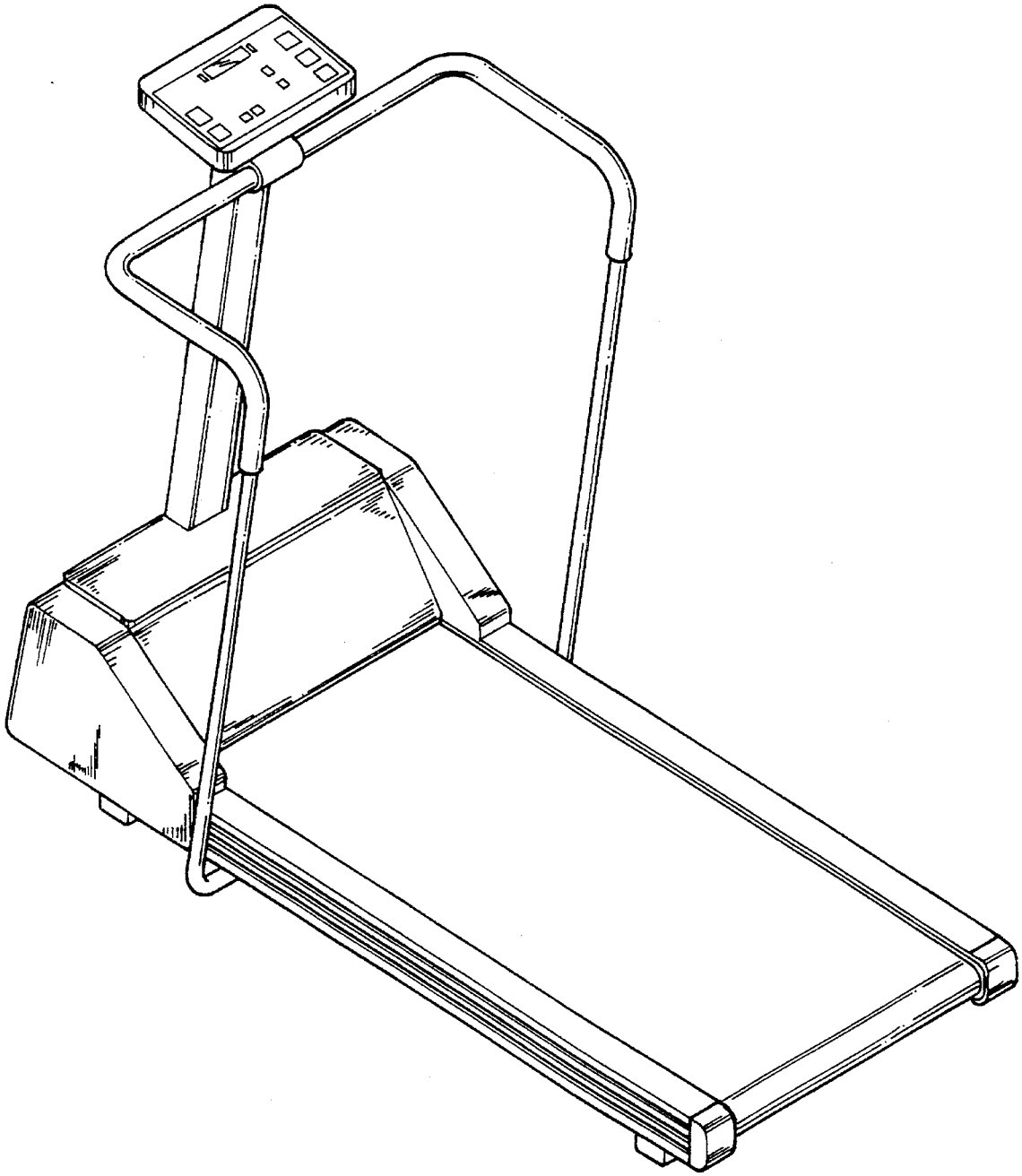
FIG. 1 PRIOR ART
FIG. 1 is a perspective outer view of a prior art treadmill.
Figure 2:
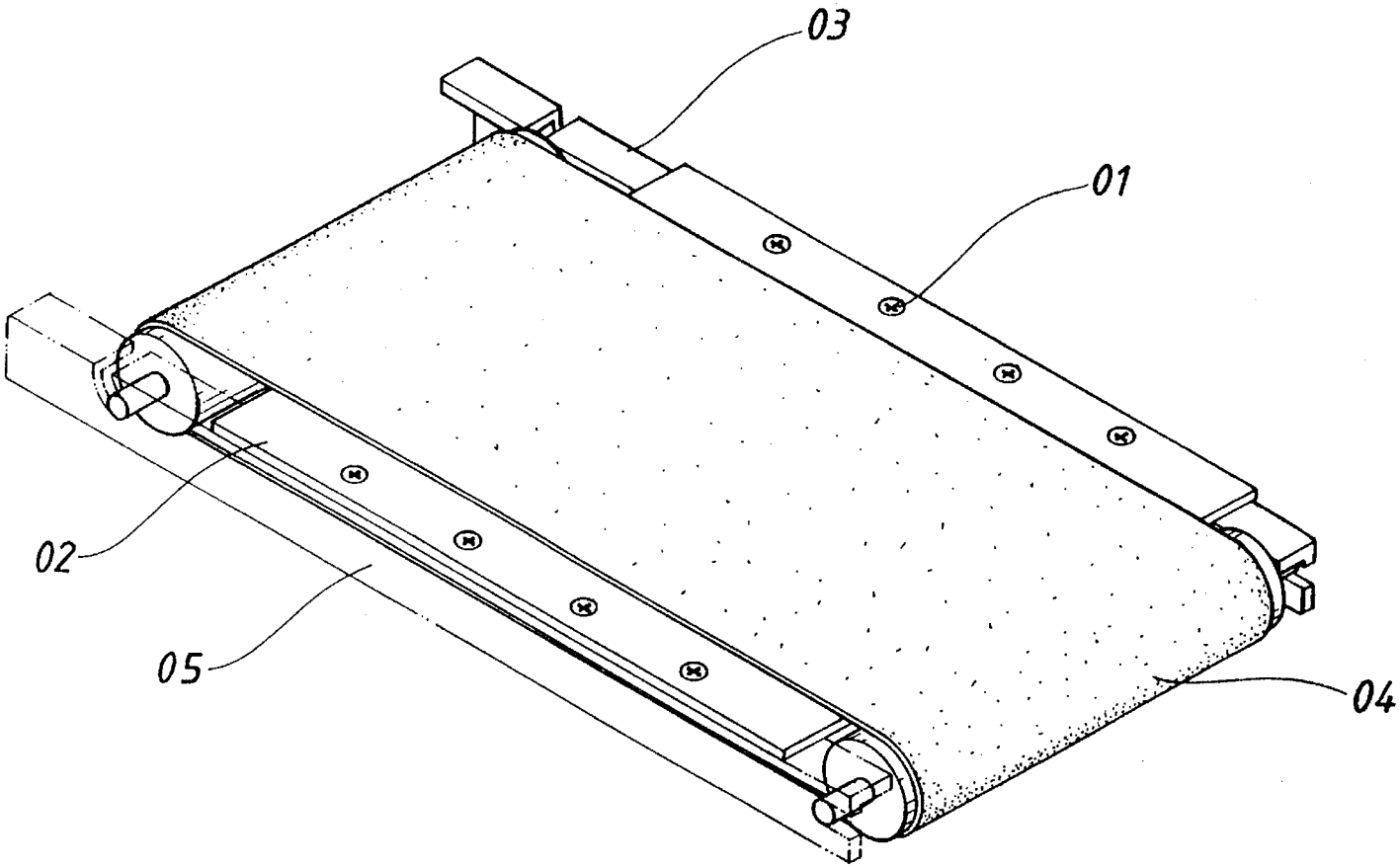
FIG. 2 PRIOR ART
FIG. 2 is a perspective view showing the outer appearance of a load carrying means used in the conventional treadmill of FIG. 1.

A conventional treadmill and its load carrying means are shown in FIGS. 1 and 2. Its construction and drawbacks have been illustrated as above and will not be described here in detail again.

Figure 3:
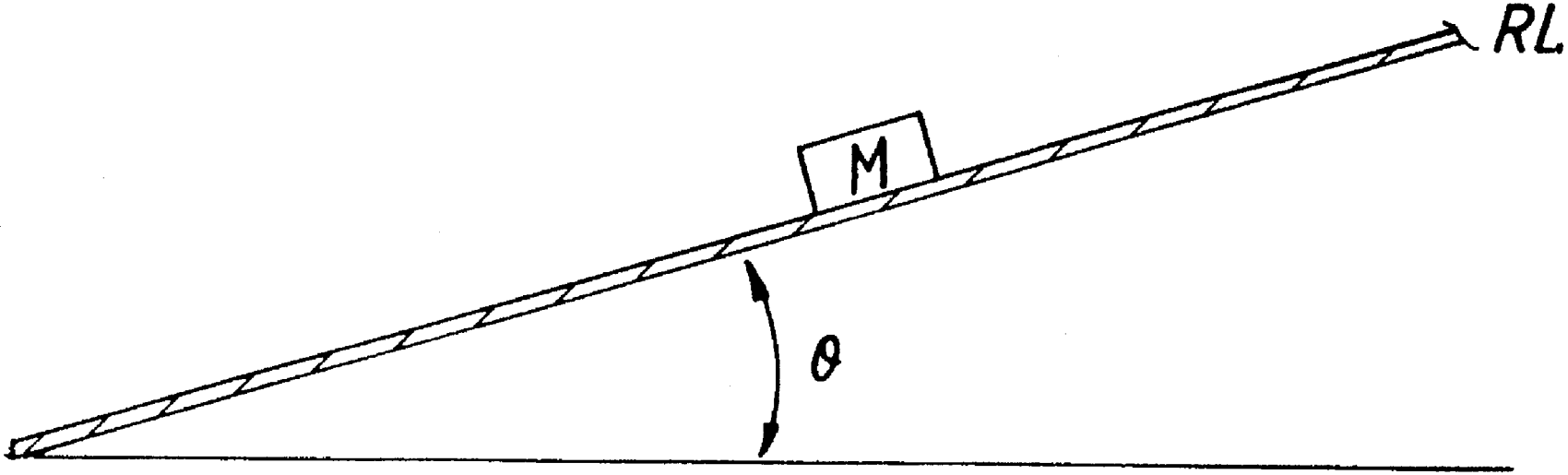
FIG. 3 illustrates the application principles of the invention.

With reference to the applied principles of the invention illustrated in FIG. 3, as known from experiments and theories, an object M on a plate RL positioned at a maximum static friction angle θ will slide down when a mechanical vibration is applied to the plate RL, that is, the equilibrium status or state of the frictional forces is broken by such a vibration motion.

Figure 4:
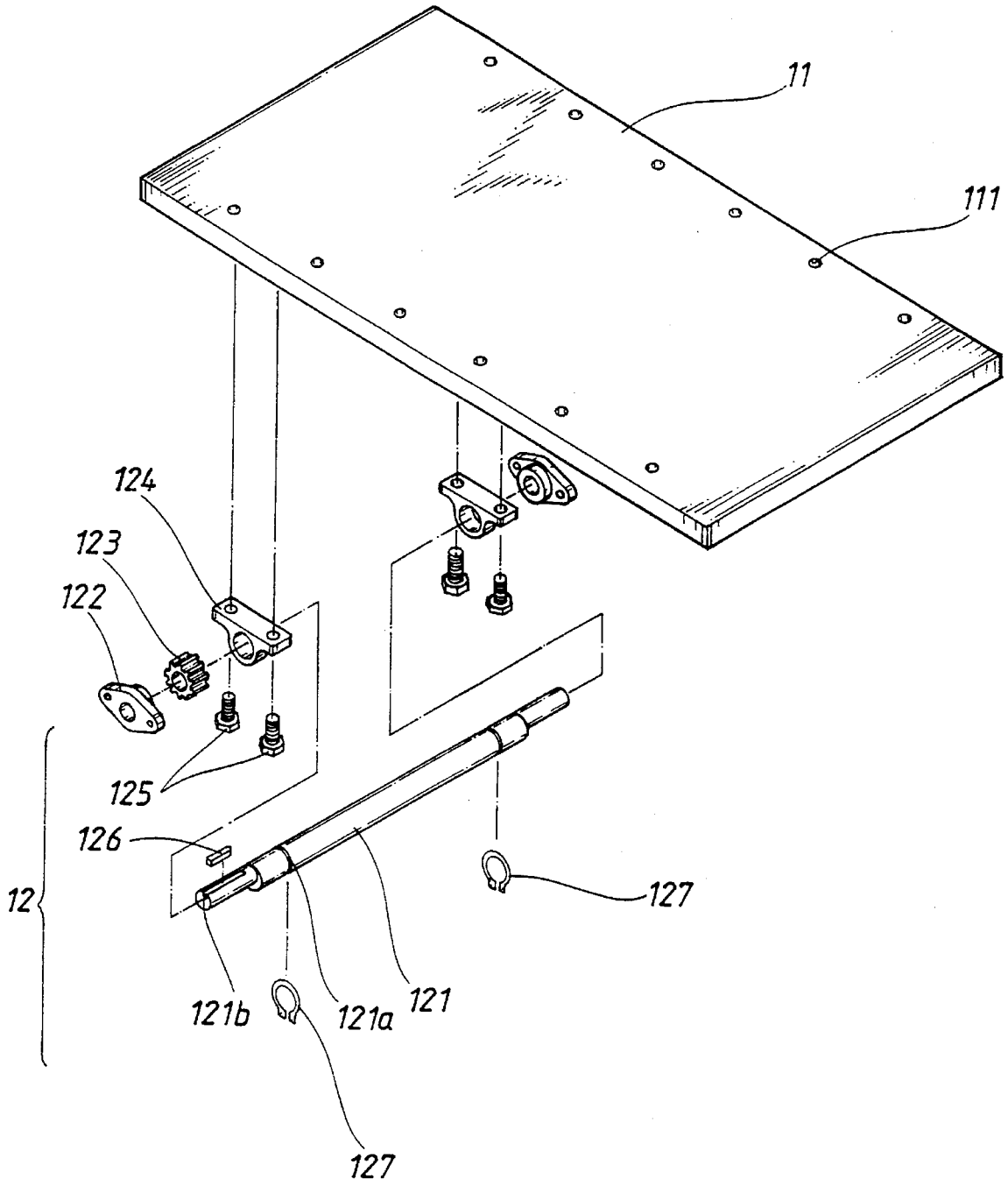
FIG. 4 is an exploded view of an embodiment of a load caging means of this invention.

FIG. 4 is an exploded view separately showing parts of an embodiment of a load carrying means according to one embodiment of the invention. An eccentric rotating device 12 is attached to supporting rails 05 of a treadmill by an eccentric shaft 121 rotating within bearing sockets 122 at ends of the shaft. The eccentric shaft 121 has grooves **121*b* disposed at proper positions near its end for receiving C-shaped retainer rings 127. Another pair of bearing sockets 124 is fixed by screws 125 on the underside of a running board 11. Arranged on the eccentric shaft 121 are keyways 121*b* associated with locating keys 126 and by the use of driven wheels 123 can be firmly mounted on the eccentric shaft 121 to drive the eccentric rotating device 12 as well as a running board 11 mounting on the rotating device 12, thereby providing a regular up and down motion to the running board 11. The running board 11 has a plurality of holes 111 formed thereon and by the use of resilient return devices is resiliently and displaceably secured on supporting rails 05**.

Figure 4A:
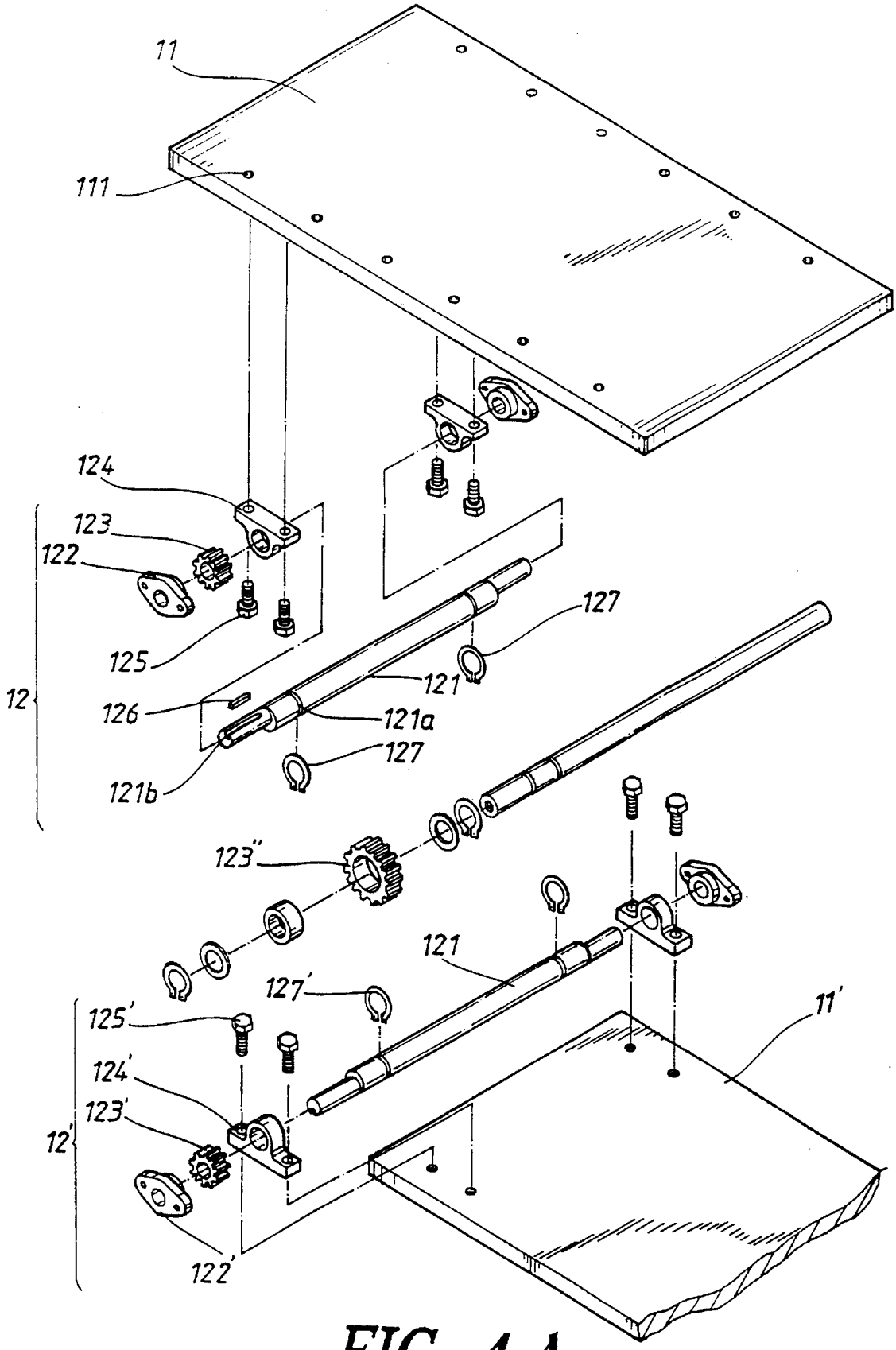
FIG. 4A is an exploded view of another embodiment of a load carrying means and secondary eccentric rotating devices of this invention.

In addition, FIG. 4A shows that right under the running board 11 and added to supporting rails 05, a flat plate 11' associated with a secondary eccentric rotating device 12' can be arranged, which is driven by a driven wheel 123' to run in the same direction as eccentric rotating, device 12, thereby causing fiat plate 11' attached thereto to move in an opposite direction relative to flat plate 11 with a vibration phase shift 180° with respect to the main eccentric rotating device 12. This can be achieved by adding a driven wheel 123' between and engaging the driven wheels 123 and 123' so as to countervail or abate vibrations.

Figure 7:
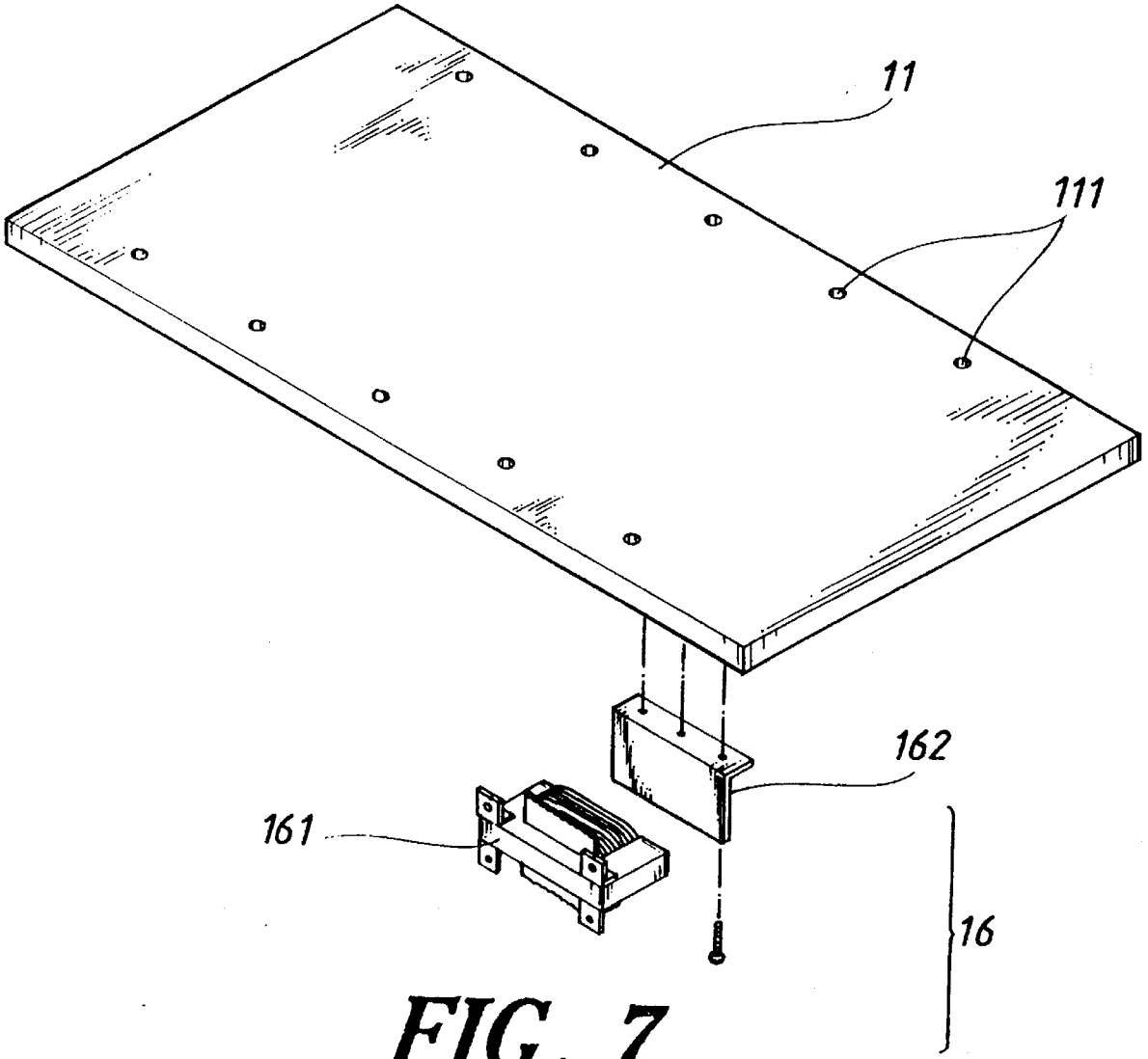
FIG. 7 is an exploded view of a further embodiment of a load carrying means according to the invention.

FIG. 7 shows another embodiment of a load carrying means, in which an electromagnet moving device 16 includes an electromagnet 161 and an iron plate 162 that provide the same function of the eccentric rotating device 12 in the first embodiment. In this case, an electromagnet 161 is fixed on supporting rails 05 of a treadmill and an iron plate 162 is fastened on the underside of a running board 11, which running board is resiliently slidably mounted on supported rails so that the board moves or is displaced when the electromagnet operates and returns to its original position when the electromagnet is inactive. By intermittent operation of electromagnet, a relative or reciprocal motion is provided between the running board 11 and the supporting rails 05, breaking the balancing of forces between the running board and the running belt and resulting in a reduction in friction.

Figure 5:
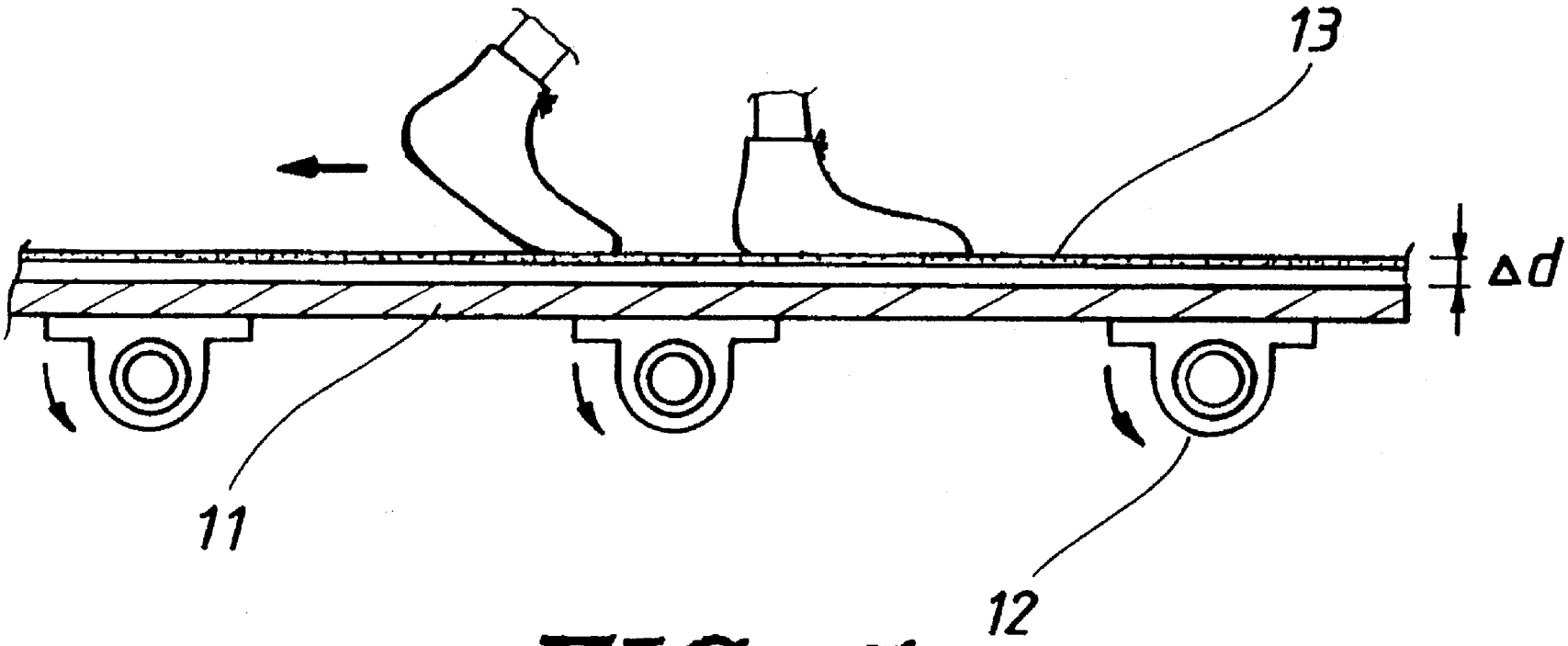
FIG. 5 is a schematic view depicting movements of the load carrying means of FIG. 4 when a load is applied thereto.

FIG. 5 is a schematic drawing showing movements of a load carrying means of the invention when a load is applied and the treadmill is operated. As can be seen from FIG. 5, the running belt 13 moves toward the back of the treadmill. The eccentric rotating device 12 rotates counterclockwise to move the running board 11 up and down. When the time the running board 11 travels from its upper dead position to its lower dead position (by action of the eccentric rotating device 12) is less than the time it freely falls, the resulting action is in favor of the running belt's direction, which is opposite to human body motion direction. On the basis of the inventor's studies, when a treadmill runs at its highest speed, 2800 rpm or 10 mile per hour, the revolution speed of the treadmill's front roller will be 1256 rpm. When an eccentric rotating device 12 is connected to a treadmill's motor, and a driven wheel having a diameter four times as large as the eccentric rotating devices's driven wheel 123 is installed on the front roller, the revolution speed of the eccentric shaft 121 can reach 5024 rpm when the motor power is transmitted through the from roller to the eccentric rotating device 12. This arrangement results with the eccentric shaft 121 rotating 83.73 revolutions per second and the running board 11 moving up and down 83.73 times per second. As the treadmill runs at 5 miles per hour, a speed that most people can reach easily, the running board 11 vibrates about 40 times per seconds. Moreover, in a prior art design of treadmills, a running belt 13 is maintained a distance from a running board 11. When the distance is four to five millimeters, noises that occur when the treadmill starts in a no-load state can be suppressed. Because the eccentric shaft 121 moves together with the running board 11 and in a counterclockwise direction, it moves the same direction as the running belt, which is against human body's motion direction. When the revolution speed of the eccentric shaft reaches a value that the time for the running board to move from its highest position to lowest position is less than the time it freely falls, the resulting action favors the running belt moving against the human body motion direction. In other words, this invention provides a structure and design that is more advantageous for a high speed running compared to the prior art. For example, in the present invention there will not be friction resulting from velocity differences when the driven wheels 123 cause the eccentric rotation device 12 to rotate at the same horizontal linear velocity as the running belt, such that there are no relative velocities differences in the horizontal direction between the running belt 13 and board 11. In this arrangement the eccentric rotating device 12 has the same horizontal linear velocity as the running belt, so that there are no relative velocities differences in the horizontal action between the running belt 13 and the running board 11, and thus there will not be friction resulting from such velocity differences. This arrangement and friction provide the invention with significant advantages over the prior art.

Figure 6:
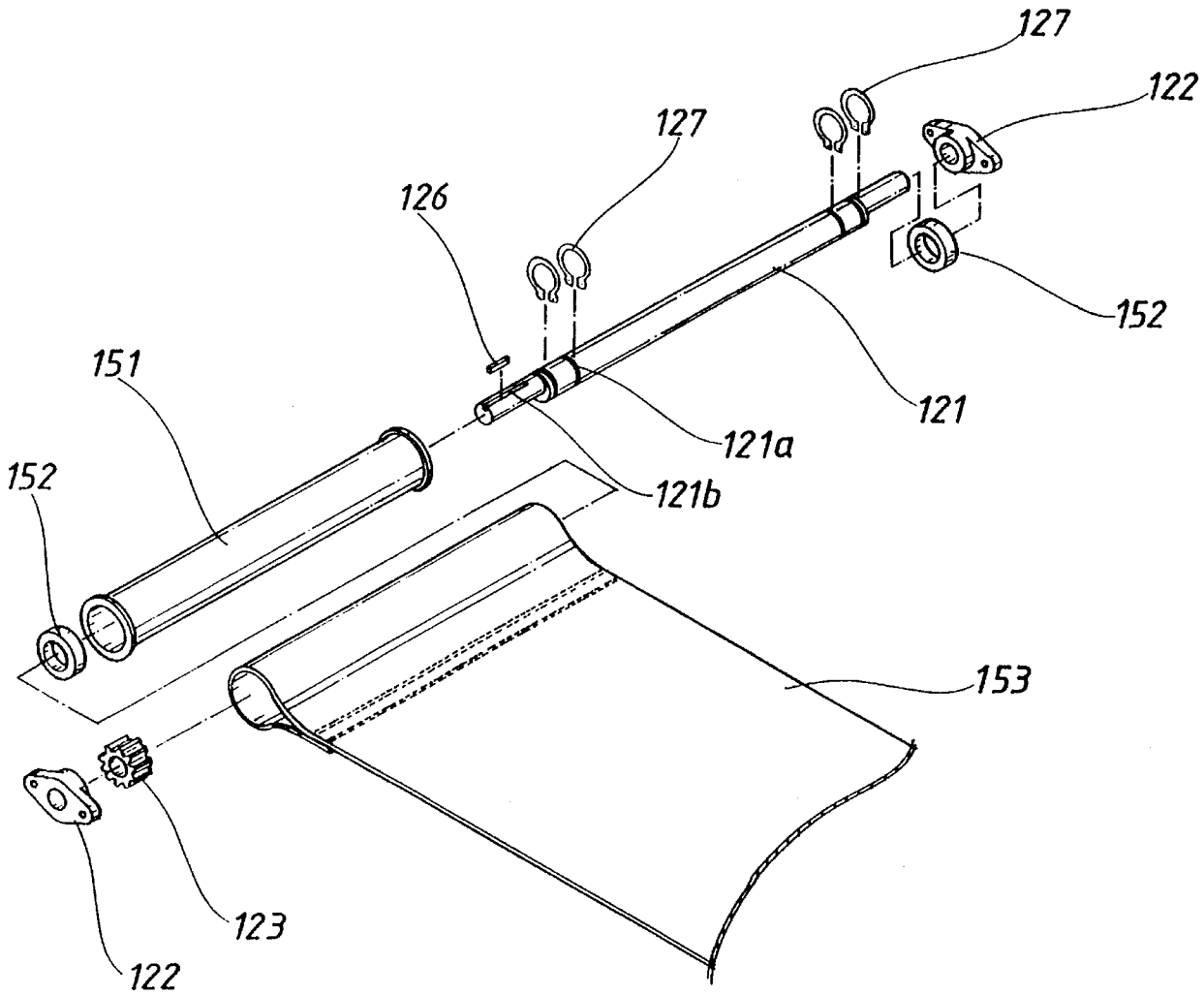
FIG. 6 is an exploded view of a modified embodiment of a load carrying means according to the invention.

FIG. 6 shows a modified embodiment of a load carrying means according to the invention. In this embodiment the load carrying means includes a running board 11 fixed on supporting rails 05 of a treadmill and an eccentric rotating device 12 attached to supporting rails 05 by a sleeve pipe 151 housing an eccentric shaft 121 supported at ends of the shaft by two socket bearings 122 on supporting rails 05. As shown in FIG. 6, the shaft 121 has grooves 121*a* arranged thereon for receiving C-shaped retainer rings 127. The sleeve pipe 151 mounts over the eccentric shaft 121 and is confined in position by bearings 151 fixed in position by C-shaped retainer rings 127. A wear-resistent and tough third medium layer 153 enveloping the sleeve pipe 151 is suspended over the running board 11. The shaft 121 further has keyways 121*b* and locating keys 126 disposed thereon that secures a driven wheel 123 for driving the eccentric rotating device and the third medium layer 153. The third medium layer 153 may be made of wear-proof and tough metal or non-metallic materials, whether or not they have an excellent low frictional coefficient or not. The friction coefficient of these materials is not so critical compared with the design of a conventional treadmill. Hence, this embodiment is more easily produced in terms of material acquisition.

Figure 8:
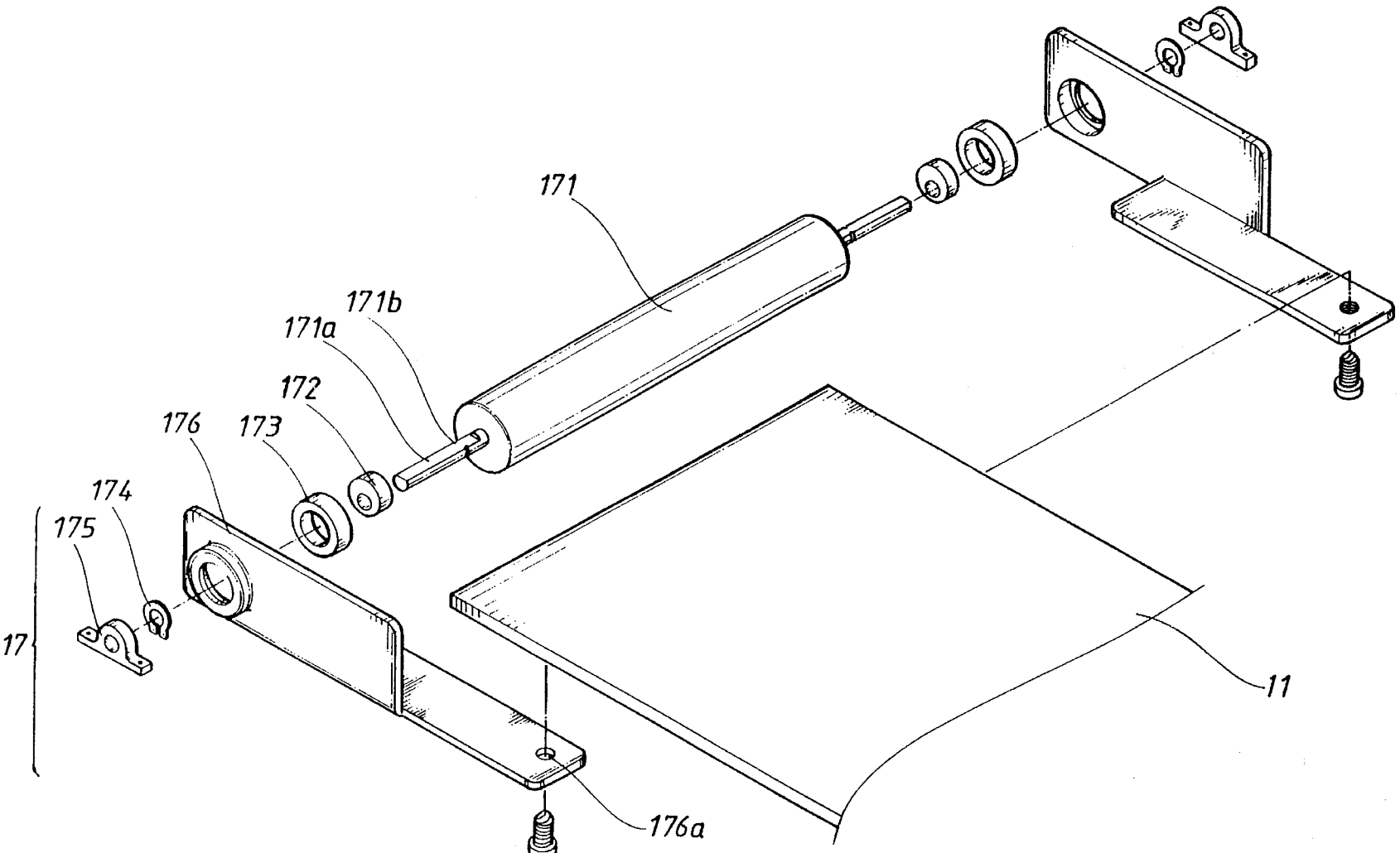
FIG. 8 is an exploded view showing still another modified embodiment of a load carrying means of the invention.

Another modified embodiment of a load carrying means according to the invention is shown in FIG. 8. As is shown therein, the eccentric rotating device 17 includes a roller 171 having axle ends with locating planes 171*a* formed thereon. The locating planes 171*a* extend through eccentric rings 172 enclosed in bearings 173 mounted inside links 176. Grooves 171*b* are formed on the locating planes 171*a* in proper positions near the roller ends to receive C-shaped retainer rings. The roller 171 extends at its axle ends into socket bearings 175 mounted on supporting rails 05 of a treadmill and is positioned by C-shaped retainer rings 174. Screws 176*b* with a needle-shaped tip pass through apertures 176*a* formed on links 176 and secure links 176 to a running board 11. Action of the running belt rotating about the running board causes the eccentric rotating device 17 to rotate. As the eccentric rotating device 17 rotates, a regular relative up and down motion occurs between the running board 11 screwed on links 176 and the supporting rails 05, breaking the equilibrium of forces between the running belt and the running board and in turn lowering friction. While the eccentric rotating device 17 shown in FIG. 8 is arranged at the front of the running board 11, it can also be arranged at the rear of the running board 11.

Figure 9:
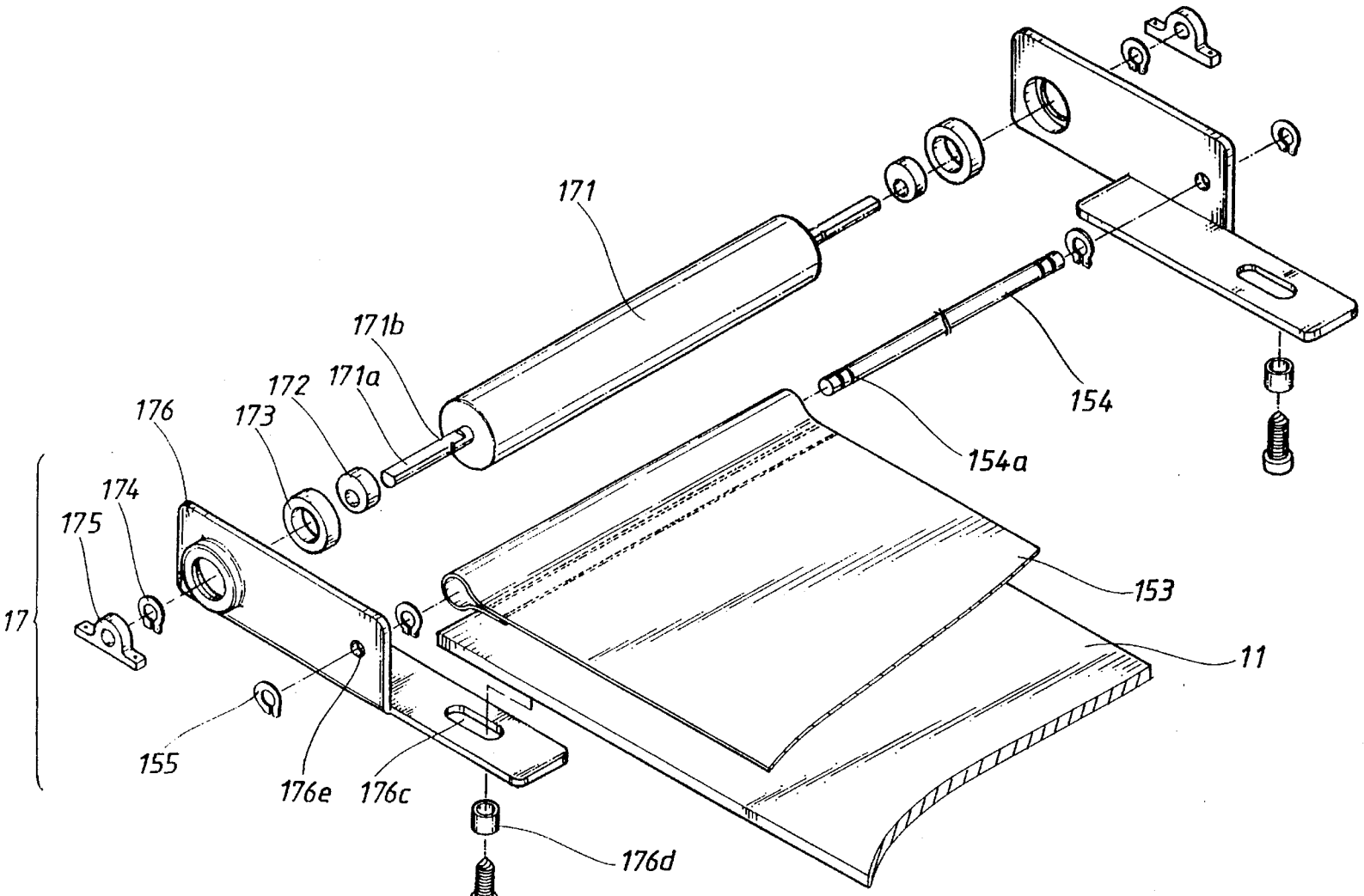
FIG. 9 is still another exploded view showing another modified embodiment of a load carrying means of the invention.

FIG. 9 is still another modified embodiment of a load carrying means of the invention. Referring to FIG. 9, a running board 11 is firmly secured on supporting rails 05 and a third medium layer 153 is placed between the running board 11 and a running belt 04. A transmission shaft 154 is connected to links 176 of an eccentric rotating device 17 and passes through holes 176*e* formed on links 176. The shaft 154 has grooves 154*a* disposed thereon to receive C-shaped retainer rings 155 that are used to prevent the third medium layer 153 from slipping out the shaft. The eccentric rotating device 17 comprises a roller 171 having axle ends with locating planes 171*a* formed thereon. The locating planes 171*a* extend through eccentric rings 172 housed in bearings 173 mounted on links 176. Grooves 171*b* are formed on the locating planes 171*a* in proper positions near the roller ends to receive C-shaped retainer tings. The roller 171 extends at its axle ends into socket bearings 175 mounted on supporting rail 05 of a treadmill and is located by C-shaped retainer tings 174. Links 176 have holes 176*e* arranged thereon through which the links 176 are attached to the third medium layer 153. The links 176 further have connecting holes 176*c* disposed thereon. Screws 176*b* with a needle-shaped tip pass through these connecting holes 176*c* and sleeves 176*d* and secure links 176 to the running board 11. The sleeves 176*d* are used to support the running board 11 and lessen friction. The running board 11 is attached to supporting rails 05 of a treadmill. As the eccentric rotating device 17 rotates, a regular relative up and down motion occurs between the third medium layer 153 attached to links 176 and the supporting rails 05, thereby breaking the equilibrium state of forces between the running belt and board and in turn lowering friction.

Furthermore, the present invention can be adapted to either an electric treadmill with an electric powder source or a mechanical treadmill using man power as the power source of its motion generating device.

From the description above, it is apparent, that the load carrying means of the present invention has the advantages of lowering friction between a running board and belt, reducing power losses in friction, enhancing the final power output of a treadmill, and heightening speed limits and load capacities for a treadmill. Thus, it is indeed a new and useful invention

What is claimed is:

1. An equilibrium breaking type load carrying means adapted to be attached to supporting rails of a treadmill, comprising:

a running belt having an upper foot surface;

a running board locating underneath said foot surface of said running belt;

a from roller and a rear roller commonly supporting said running belt and attached to said supporting rails of said treadmill; and at least one motion generating device attached to said supporting rails of said treadmill underneath said foot surface of said running belt, said at least one motion generating device permitting free movement of said running belt and generating a reciprocal relative motion between said running board and said running belt and perpendicular to said running belt while said running belt moves with an external load thereon for reducing friction between said running belt and said running board.

2. An equilibrium breaking type load carrying means as claimed in claim 1, wherein an addition layer is positioned between said running board and said running belt and acts a friction medium.

3. An equilibrium breaking type load carrying means as claimed in claim 1, wherein said motion generating device is an eccentric rotating device comprising:

an eccentric shaft having a driven wheel mounted thereon and first socket bearings disposed at two end of said eccentric shaft, said first socket bearings securing said shaft ends to said supporting rails of said treadmill, and second socket bearings attaching said eccentric shaft to said running board and arranged so that when said eccentric rotating device rotates said driven wheel of said eccentric shaft, said running belt rotates about said eccentric shaft producing said reciprocal relative motion between said running belt and said running board.

4. An equilibrium breaking type load carrying means as claimed in claim 3, wherein a flat plate is arranged under said running board and a second motion generating device is interposed between said running board and said flat plate, said second motion generating device providing an opposite rotating direction and a phase shift of 180° relative to said motion generating device attached to said running board for reducing vibration.

5. An equilibrium breaking type load carrying means as claimed in claim 1, wherein said motion generating device includes a plurality of eccentric rotating devices for providing said running board with movement in a direction of at least one of a direction parallel to a moving direction of said running belt, a direction perpendicular to said moving direction of said running belt and in a direction of ground surface.

6. An equilibrium breaking type load carrying means as claimed in claim 1, wherein said motion generating device is an electromagnet device composed of at least one electromagnet attached to said supporting rails of said treadmill and at least one iron plate fixed on said running board, and intermittent operation of said electromagnet produces said relative motion between said running board and running belt.

7. An equilibrium breaking type load carrying means as claimed in claim 1, wherein an additional layer is positioned between said running board and said running belt and acts as a friction medium, and a second motion generating device is attached to said additional layer for balancing vibrations produced by said motion generating devices; said secondary motion generating device moving in an opposite direction to said motion generating device and with a phase shift of 180° relative to said motion generating devices.

8. An equilibrium breaking type load carrying means as claimed in claim 1, comprising a plurality of said motion generating devices for providing said running board with movement in a direction of one of at least one of a direction parallel to a moving direction of said running belt, a direction perpendicular to said moving direction of said running belt and in a direction of ground surface.

9. An equilibrium breaking type load carrying means as claimed in claim 1, wherein including an additional layer between said running belt and said running board that acts as a friction medium, and said motion generating device is an electromagnet device composed of at least one electromagnet attached to said supporting rails of said treadmill and at least one iron plate connected to said additional layer, and intermittent operation of said electromagnet produces a regular relative motion between said additional layer and said running belt.

10. An equilibrium breaking type load carrying means as claimed in claim 1, wherein said motion generating device is an eccentric rotating device comprising another roller arranged in front of said running board having eccentric rings mounted thereon and axle ends attached to said supporting rails of said treadmill, revolving movement of said running belt causing said another roller to rotate, resulting in said eccentric tings producing said reciprocal relative motion between said running belt and said running board.

11. An equilibrium breaking type load carrying means as claimed in claim 1, wherein said motion generating device is an eccentric rotating device comprising another roller arranged at a rear of said running board having eccentric rings mounted thereon and axle ends attached to said supporting rails of a treadmill, revolving movement of said running belt causing said another roller to rotate, resulting in said eccentric ring producing said reciprocal relative motion between said running belt and said running board.

* * * * *